US007806556B2

(12) United States Patent
Wu

(10) Patent No.: US 7,806,556 B2
(45) Date of Patent: Oct. 5, 2010

(54) REFLECTION LAMP

(76) Inventor: Jiahn-Chang Wu, No. 15, Lane 13, Alley 439, Her-Chiang Street, Chutung, Hsin-Chu (TW) 310

( * ) Notice: Subject to any disclaimer, the term of this patent is extended or adjusted under 35 U.S.C. 154(b) by 0 days.

(21) Appl. No.: 12/041,109

(22) Filed: Mar. 3, 2008

(65) Prior Publication Data

US 2009/0185386 A1 Jul. 23, 2009

(30) Foreign Application Priority Data

Jan. 21, 2008 (TW) ..... 97102136 A

(51) Int. Cl.
*F21V 1/00* (2006.01)

(52) U.S. Cl. ..... 362/235

(58) Field of Classification Search ..... 362/26, 362/27, 235, 236, 249.16, 806, 808
See application file for complete search history.

(56) References Cited

U.S. PATENT DOCUMENTS 4,280,171 A * 7/1981 Huang ..... 362/240
5,136,483 A * 8/1992 Schoniger et al. ..... 362/545
6,193,383 B1 * 2/2001 Onikiri et al. ..... 362/26
6,533,429 B2 * 3/2003 Yoneda ..... 362/600
6,988,815 B1 * 1/2006 Rizkin et al. ..... 362/245
2004/0233664 A1 * 11/2004 Beeson et al. ..... 362/231
2005/0002190 A1 * 1/2005 Kramer et al. ..... 362/236
2005/0185409 A1 * 8/2005 Mayer ..... 362/350
2005/0281048 A1 * 12/2005 Coushaine et al. ..... 362/555
2006/0245208 A1 * 11/2006 Sakamoto et al. ..... 362/612
2006/0268543 A1 * 11/2006 Rains, Jr. ..... 362/231
2007/0153552 A1 * 7/2007 Huang ..... 362/656

* cited by examiner

*Primary Examiner*—Jong-Suk (James) Lee
*Assistant Examiner*—Julie A Shallenberger
(74) *Attorney, Agent, or Firm*—Lowe Hauptman Ham & Berner, LLP

(57) ABSTRACT

A metal base has a mounting hole made in the wall for housing a light unit, and a reflection surface opposite to the hole for reflecting the light from the light unit to form a reflection lamp with high heat dissipation ability.

17 Claims, 7 Drawing Sheets

REFLECTION LAMP

RELATED APPLICATIONS

The present application is based on, and claims priority from, Taiwan Application Serial Number 097102136, filed Jan. 21, 2008, the disclosure of which is hereby incorporated by reference herein in its entirety.

TECHNICAL FIELD

This disclosure is related to a reflection lamp, especially to a lamp having a reflection surface, all the light rays are reflected at least once before exiting the lamp.

BACKGROUND

FIG. 1 Prior Art

FIG. 1 shows a prior art lamp which is composed of a plurality of light emitting diodes (LEDs) 11 mounted on a circuit board 10. The disadvantage is that the poor heat dissipation ability of the circuit board 11 results in a temperature rising of the whole light module and hence causes a lower light efficiency of the LED. It has been well known for persons skilled in the art that the light efficiency decreases when the temperature increases for a LED. Further, the direct light emission is quite harsh to user's eyes.

SUMMARY OF THE INVENTION

It is a first object of this invention to develop a reflection lamp to eliminate harsh light from being shed to user's eyes. It is a second object of this invention to develop a reflection lamp with different outline. It is a third object of this invention to develop a reflection lamp easy to maintain.

DETAILED DESCRIPTION

A combination of metal plate, a reflection surface, and a light unit forms a Reflection lamp. The metal plate provides good ability for heat dissipation. A through hole or recess is made on a wall of the plate to house a light unit inside, so that all the light rays from the light unit are reflected at least once before exiting the lamp. The Reflection lamp emits lights indirectly toward the environment which eliminates the harsh light a traditional lamp has to user's eyes.

Figure 2:
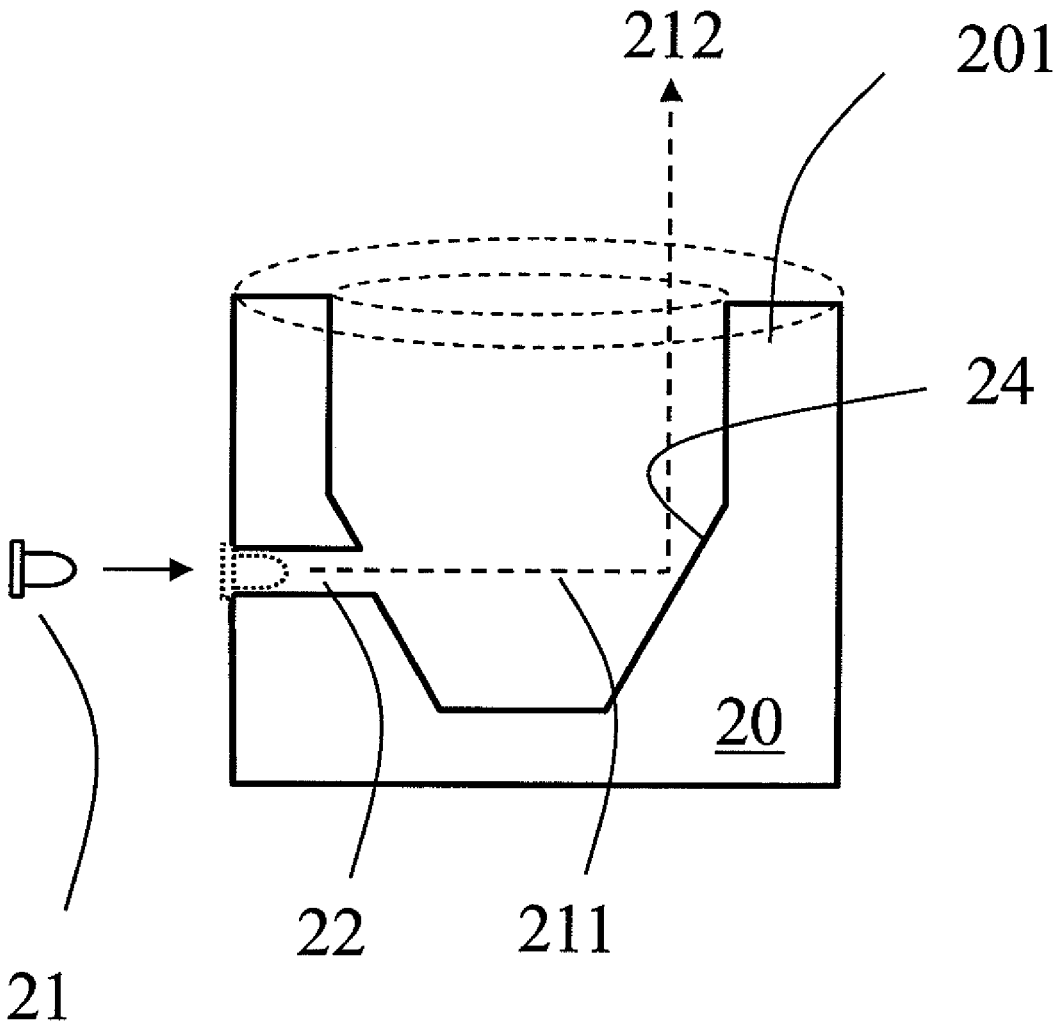
FIG. 2. shows a first embodiment of this invention.

FIG. 2 Shows a First Embodiment

A Reflection lamp comprises: a metal cup 20 having a cup wall 201; at least a mounting hole 22 is made through the cup wall 201; a light unit 21 is placed inside the mounting hole 22 for emitting a light beam 211; and a reflection surface 24 is arranged in a position opposite to the light unit 21 for reflecting the light beam 211 there from; a reflected light beam 212 comes from the reflection surface 24 and then exits the lamp to form a Reflection lamp. The mounting hole 22 is illustrated to be made through the wall as an example only, it can be a recess on the wall. When the mounting is made through the wall, a failure light unit 21 can be changed easily from outside the lamp.

Figure 3:
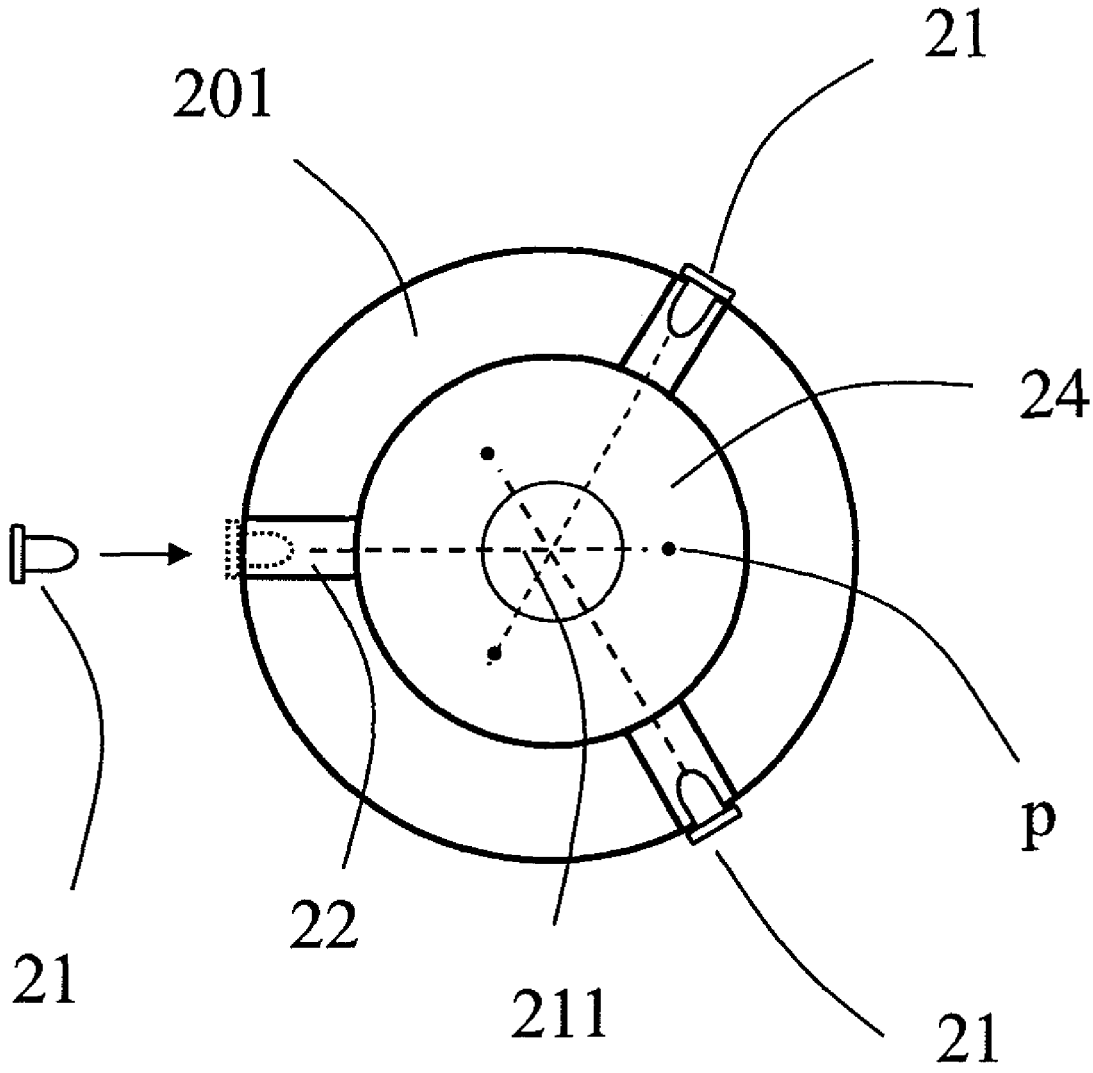
FIG. 3. shows a section view of FIG. 2.

FIG. 3 Shows a Section View for FIG. 2

FIG. 3 shows three mounting holes 22, which are made through the cup wall 201, a light unit 21 is placed in each of the mounting holes 22. The light beam 211 emitted from the light unit 21 reaches a reflection surface 24 which is opposite to the mounting hole 22. The light beam 211 from the light unit 21 is then reflected at point P on the reflection surface 24, the reflected light beam 212 (shown in FIG. 2) then exits the lamp.

Figure 4:
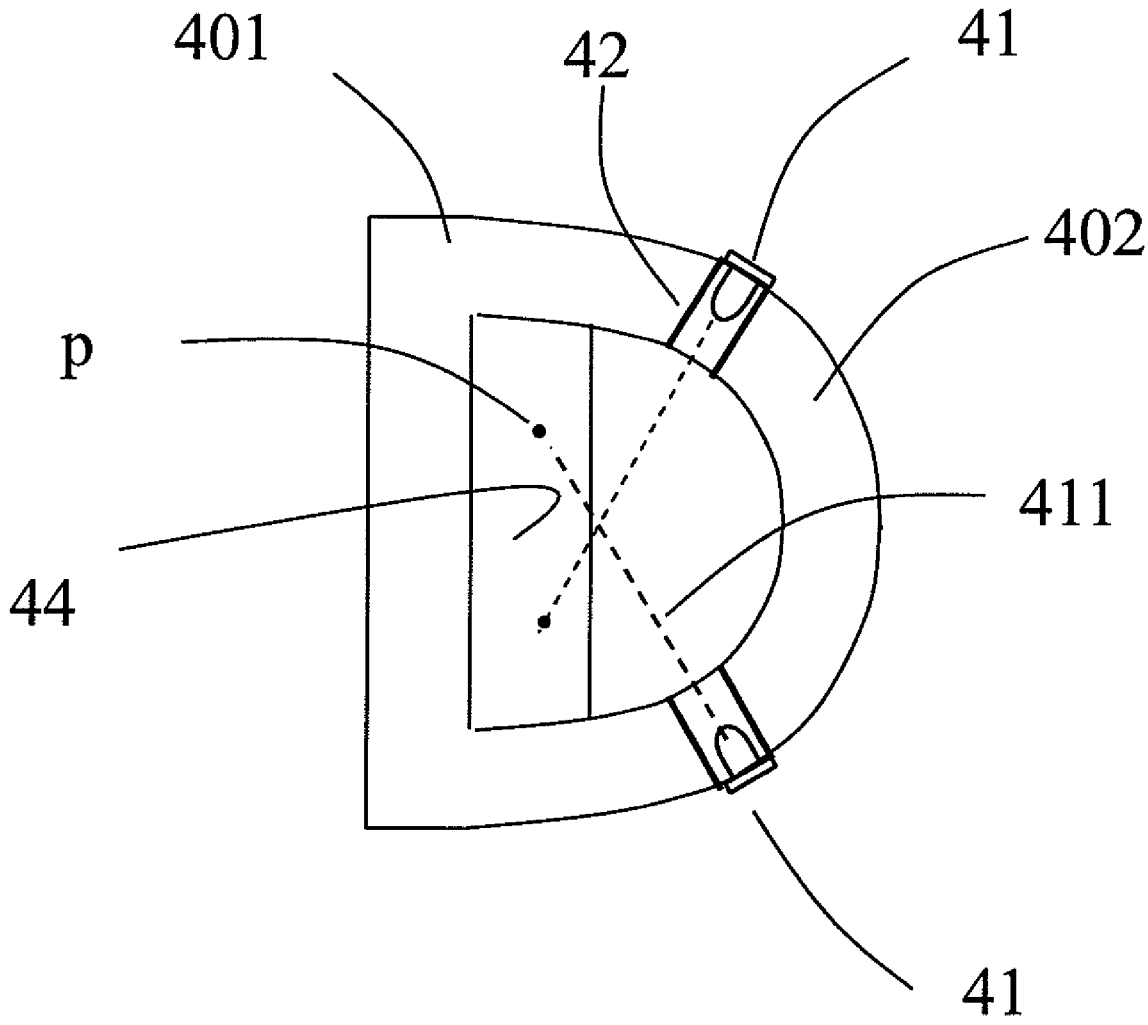
FIG. 4. shows a second embodiment of this invention.

FIG. 4 Shows a Second Embodiment

This design is similar to FIG. 2 but with a D-shaped wall 401. A mounting hole 42 is made through the cup wall 401, a light unit 41 is placed inside the mounting hole 42 for emitting a light beam 411; and a reflection surface 44 is arranged on a position to reflect the light beam 411 from the light unit 41; the light beam 411 is reflected by the reflection surface 44 at point P, a reflected beam 412 then exits the lamp to form a Reflection lamp.

Figure 5:
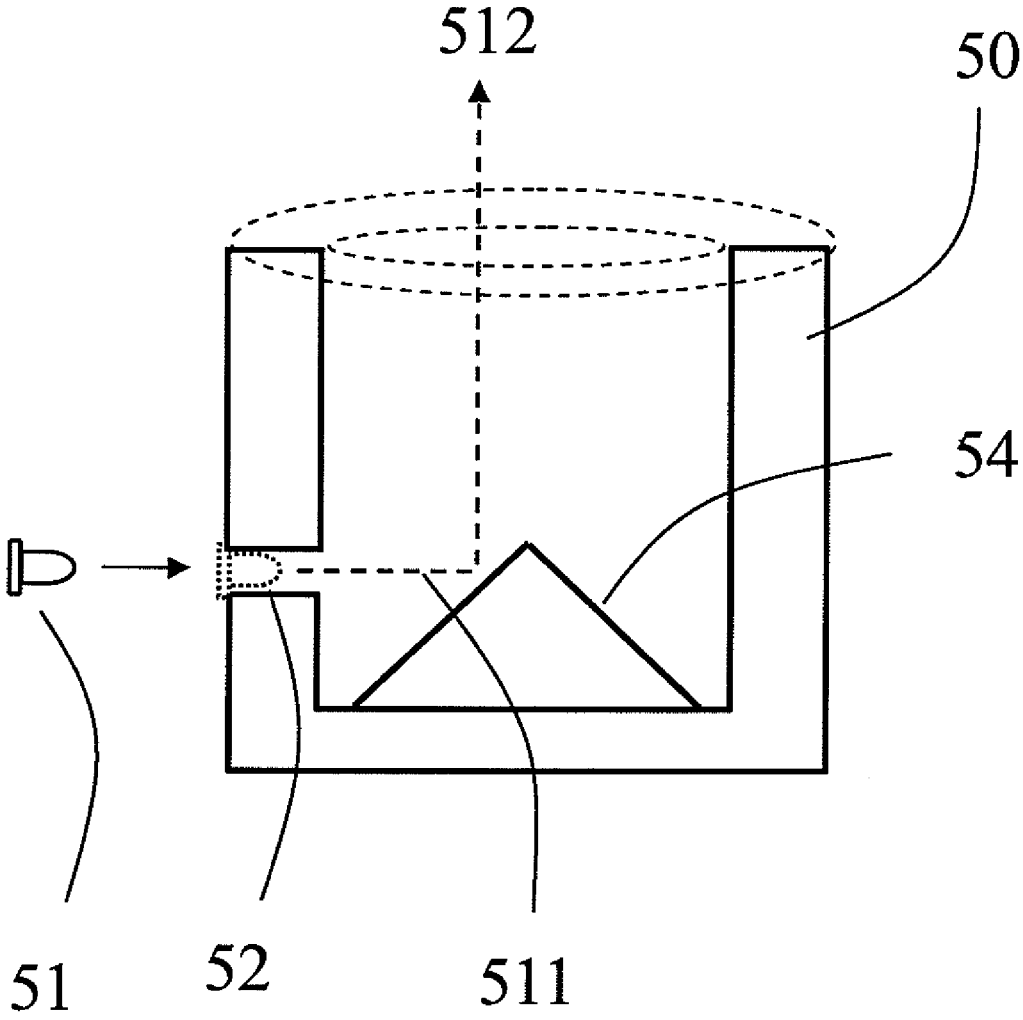
FIG. 5. shows a third embodiment of this invention.

FIG. 5 Shows a Third Embodiment

A cone reflection surface 54 is placed in a center of the metal cup 50. A mounting hole 52 is made through the cup wall of the metal cup 50 for housing a light unit 51. The light unit 51 emits a light beam 511. The cone reflection surface 54 reflects light beam 511 from the light unit 51; a reflected light beam 512 comes from the reflection surface 54, and exits the lamp to form a Reflection lamp.

Figure 6:
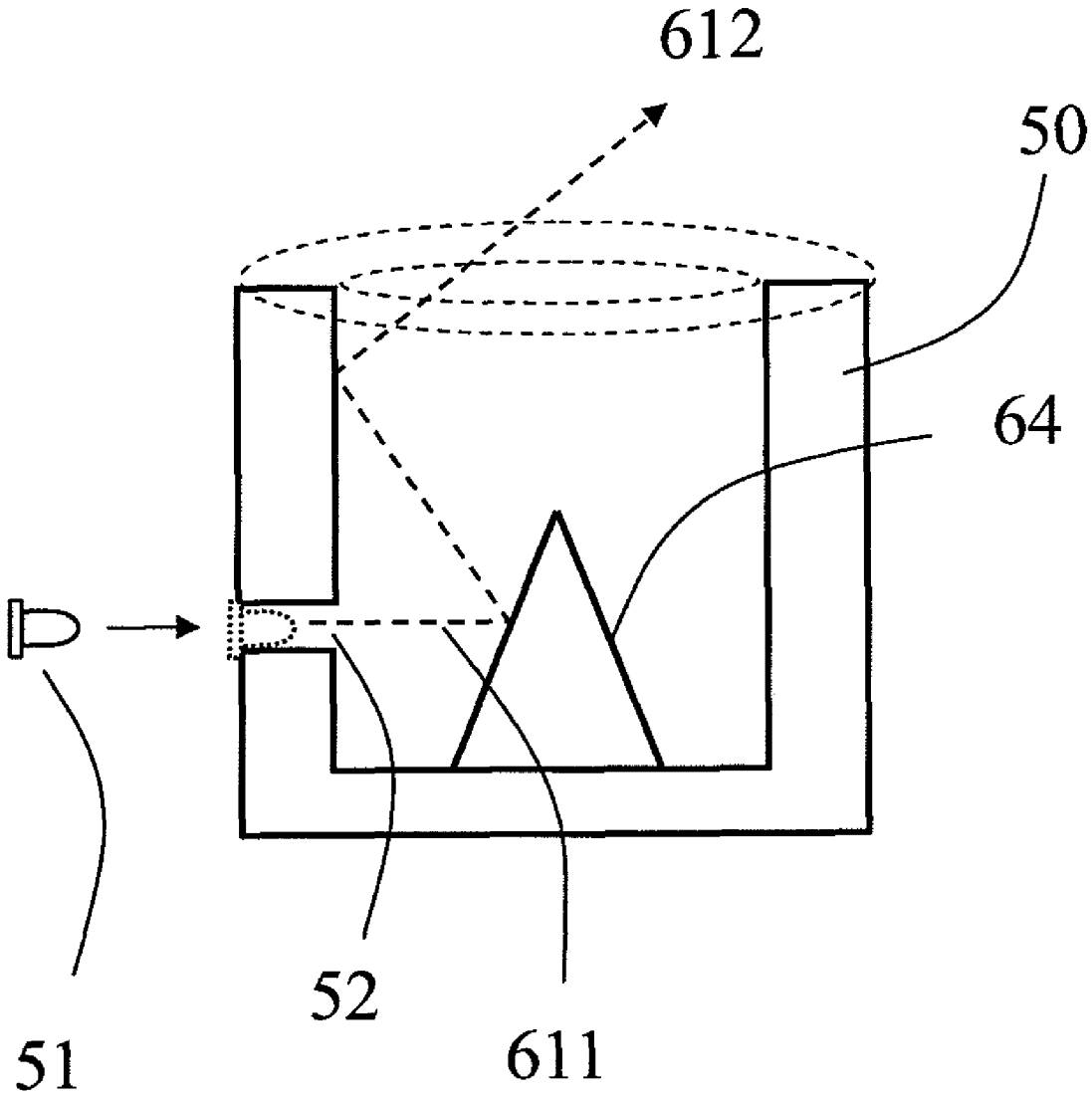
FIG. 6. shows a fourth embodiment of this invention.

FIG. 6 Shows a Fourth Embodiment

This design is similar to but a little different from FIG. 5, the difference is at the reflection angle of the reflection surface 64. The cone reflection surface 64 is made steeper then that of FIG. 5. With this design, the light beam 611 is reflected more times before exiting the lamp.

Figure 7:
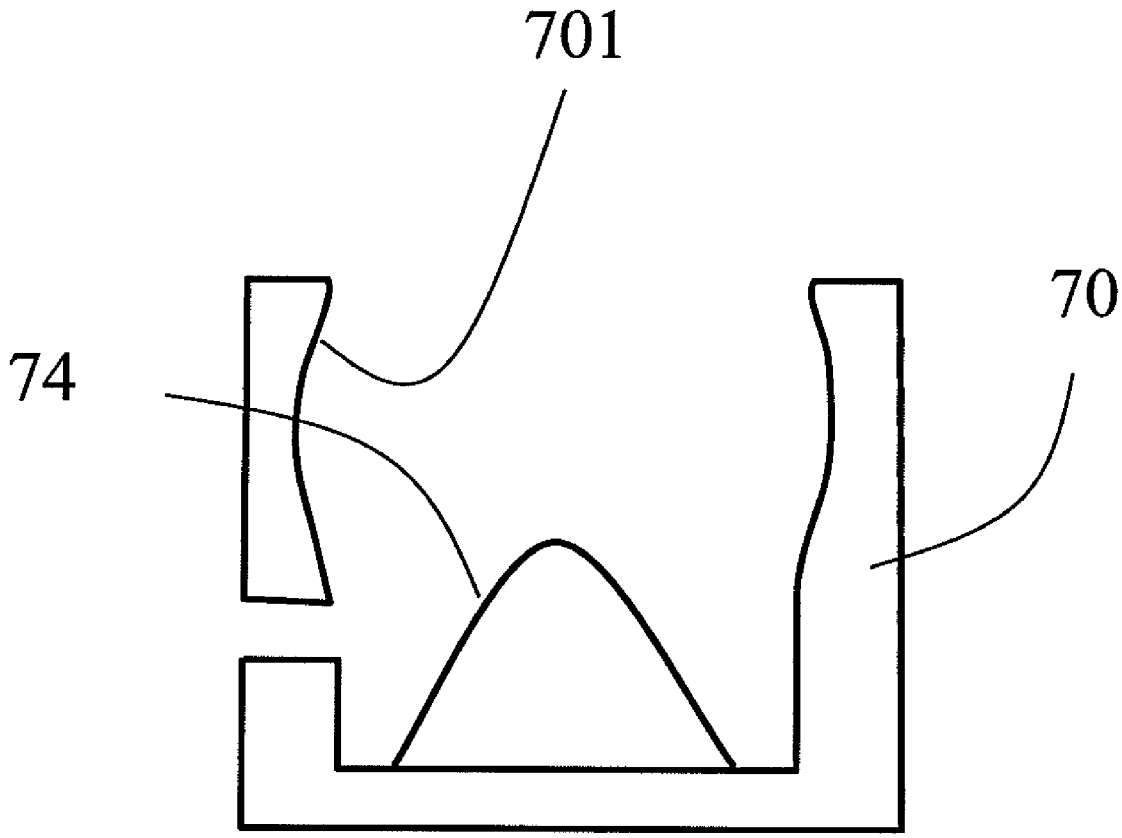
FIG. 7. shows a fifth embodiment of this invention.

FIG. 7 Shows a Fifth Embodiment

This design is different from prior designs only at the shape of the reflection surface. The first reflection surface 74 and the second reflection surface 701 are designed to be with curves so as to produce different lighting exiting effects.

The light unit used in this specification is only exampled with a light emitting diode, however a laser diode unit or other type light units known to a person skilled in the art can be used to achieve similar effect.

While the preferred several embodiments have been described by way of example, it will be apparent to those skilled in the art that various modifications may be made in the embodiments without departing from the spirit of the present invention. Such modifications are all within the scope of the present invention, as defined by the appended claims.

BRIEF DESCRIPTION OF THE DRAWING

Figure 1:
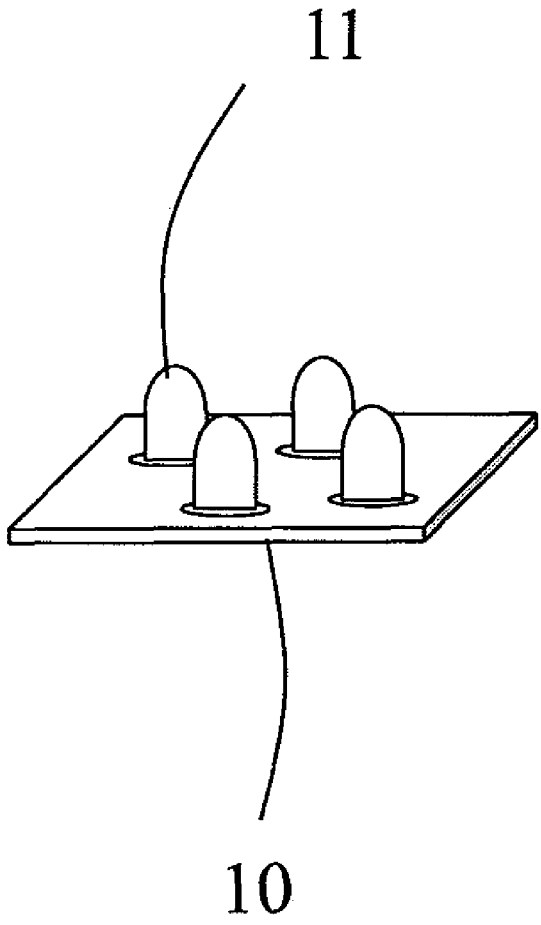
Fig.1. Prior Art
FIG. 1. shows a prior art device.

FIG. 1 shows a prior art
FIG. 2 shows a first embodiment of the invention FIG. 3 shows a section view of FIG. 2

FIG. 4 shows a second embodiment of the invention

FIG. 5 shows a third embodiment of the invention

FIG. 6 shows a fourth embodiment of the invention

FIG. 7 shows a fifth embodiment of the invention

What is claimed is:

1. A reflection lamp, comprising:

a heat sink base in a shape of a cup;

a light unit removably mounted inside a through hole which extends through a side wall of the cup, said through hole comprising:

an inner open end facing an inside of the cup for directing light emitted from the light unit toward the inside of the cup; and an outer open end facing an outside of the cup and being configured for mounting or replacing said light unit inside the through hole from the outside of the cup; and a reflection surface within the cup for reflecting the light emitted from the light unit toward an opening of the cup;

wherein the light unit is recessed within the through hole, without projecting beyond the inner open end of the through hole, so that all light rays emitted from the light unit are reflected at least once before existing the cup.

2. A reflection lamp as claimed in claim 1, wherein the side wall of the cup has a curved inner surface as seen in a horizontal section view of the cup.

3. A reflection lamp as claimed in claim 1, wherein the side wall of the cup has a curved inner surface as seen in a vertical section view of the cup.

4. A reflection lamp as claimed in claim 1, wherein the light unit is a light emitting diode.

5. A reflection lamp as claimed in claim 1, wherein the light unit is a laser diode.

6. A reflection lamp as claimed in claim 1, wherein the reflection surface is on the side wall at a location opposite to the inner open end.

7. A reflection lamp as claimed in claim 1, wherein the reflection surface is a flat surface.

8. A reflection lamp as claimed in claim 1, wherein the reflection surface is a cone surface.

9. A reflection lamp as claimed in claim 1, wherein the reflection surface is curved.

10. A reflection lamp as claimed in claim 1, wherein the base is made of a material selected from the group consisting of: metal, graphite composite, ceramic, and diamond-coated composite.

11. A reflection lamp as claimed in claim 1, wherein the reflection surface is provided on a structure projecting from a bottom of the cup toward the opening of the cup.

12. A reflection lamp as claimed in claim 11, wherein the structure is tapered toward the opening of the cup.

13. A reflection lamp as claimed in claim 1, wherein the light unit comprises a flange located outside the through hole and outside the cup; and a light emitting structure which is on the flange and from which the light beam is emitted, wherein the light emitting structure is recessed within the through hole without projecting beyond the inner open end of the through hole.

14. A reflection lamp as claimed in claim 13, wherein the light emitting structure is completely recessed within the through hole without projecting beyond or being flush with the inner open end of the through hole.

15. A reflection lamp as claimed in claim 13, wherein the light emitting structure occupies only about half a depth of the through hole between the inner open end and the outer open end.

16. A reflection lamp as claimed in claim 12, wherein the structure has an upper portion coelevational with the inner open end of the through hole.

17. A reflection lamp as claimed in claim 11, wherein the structure has an upper portion located on an axis of the through hole.

* * * * *